United States Patent [19]

Urata

[11] Patent Number: 4,607,005

[45] Date of Patent: Aug. 19, 1986

[54] SILVER HALIDE PHOTOGRAPHIC EMULSIONS

[75] Inventor: Yukihide Urata, Kanagawa, Japan

[73] Assignee: Fuji Photo Film Co., Ltd., Kanagawa, Japan

[21] Appl. No.: 766,313

[22] Filed: Aug. 16, 1985

[30] Foreign Application Priority Data

Aug. 18, 1984 [JP] Japan ..... 59-171735

[51] Int. Cl.[4] ..... G03C 1/28; G03C 7/32

[52] U.S. Cl. ..... 430/550; 430/554; 430/555; 430/574

[58] Field of Search ..... 430/550, 554, 555, 574

[56] References Cited

U.S. PATENT DOCUMENTS 3,840,373 10/1974 Shiba et al. ..... 430/574

4,179,296 12/1979 Sato et al. ..... 430/574

4,362,813 12/1982 Mihara et al. ..... 430/550

*Primary Examiner*—Mary F. Downey

*Attorney, Agent, or Firm*—Sughrue, Mion, Zinn, Macpeak, and Seas

[57] ABSTRACT

A silver halide photographic emulsion comprising silver halide, binder, and sensitizing dyes of formulas (I), (II), (III):

(I)

$(X^{\ominus})_{n-1}$ $R_1$, $R_2$ represent substituted or unsubstituted alkyl, one of $R_1$ and $R_2$ being sulfoalkyl or carboxyalkyl; R represents alkyl or aralkyl; $W_1$, $W_2$, $W_3$, $W_4$, being the same or different, represent hydrogen, halogen, aryl, alkyl, substituted alkyl, alkoxy, alkoxycarbonyl, carboxy, or hydroxy, provided $W_1$ and $W_2$ are not both a phenyl; $X^{\ominus}$ represents an acid anion; n represents 1 or 2, n being 1 when the dye forms an intramolecular salt;

(II)

$(X_1^{\ominus})_{m-1}$ $R_4$, $R_5$ represent substituted or unsubstituted alkyl; at least one of $R_4$ and $R_5$ being sulfoalkyl or carboxyalkyl; $R_3$ represents ethyl, propyl, or aralkyl; $V_1$, $V_2$, $V_3$, $V_4$, $V_5$, $V_6$, $V_7$, being the same or different, represent hydrogen, halogen, aryl, alkyl, substituted alkyl, alkoxy, alkoxycarbonyl, carboxy, or hydroxy, provided any of $V_1$ and $V_2$, $V_2$ and $V_3$, $V_3$ and $V_4$, $V_5$ and $V_6$, or $V_6$ and $V_7$ may combine into a benzene ring; $X_1^{\ominus}$ represents an acid anion; m represents 1 or 2, m being 1 when the dye forms an intramolecular salt;

(III)

$(X_2^{\ominus})_{e-1}$ $R_6$, $R_7$, $R_8$, being the same or different, represent an aliphatic group; $U_1$, $U_2$, $U_3$, $U_4$, being the same or different, represent hydrogen, halogen, aliphatic hydrocarbon, acyl, acyloxy, alkoxycarbonyl, carbamoyl, sulfamoyl, cyano, trifluoromethyl or hydroxy; A represents a sulfo or carboxy; $X_2^{\ominus}$ represents an acid anion; h is 1 to 6; and e represents 1 or 2.

15 Claims, No Drawings

SILVER HALIDE PHOTOGRAPHIC EMULSIONS

FIELD OF THE INVENTION

This invention relates to a silver halide photographic emulsion spectrally sensitized by a combination of at least three sentisizing dyes exhibiting a supersentitizing action in combination, and more particularly to a silver halide photographic emulsion having improved spectral sensitivity to light in the green spectral region.

BACKGROUND OF THE INVENTION

Spectral sensitization techniques are well known for photographic materials, i.e., techniques of expanding the light sensitive wavelength region of a silver halide photographic emulsion to make the emulsion sensitive to light having a longer wavelength by adding a certain cyanine dye or dyes to the photographic emulsion. It is also known that the sensitivity obtained by a spectral sensitization ("spectral sensitivity") is influenced by the chemical structure of a sensitizing dye and various properties of the silver halide emulsion such as, for example, the halide composition of silver halide, the crystal habit and crystal system of silver halide, the silver halide concentration, the hydrogen ion concentration, etc. Furthermore, spectral sensitization is also influenced by photographic additives present in the silver halide emulsion, such as stabilizers, antifoggants, coating aids, precipitants, color couplers, hardening agents, etc.

In general, one sensitizing dye is used for sensitizing a specific spectral wave length region of a silver halide photographic emulsion. When a combination of two, three or more sensitizing dyes is used for sensitizing a silver halide emulsion, the sensitivity of the silver halide emulsion obtained is generally lower than that of a silver halide emulsion obtained by using each of the sensitizing dyes individually. However, the use of a combination of a certain sensitizing dye and one or more other sensitizing dyes sometimes super-additively and greatly increases the spectral sensitivity of a silver halide emulsion, a phonomenon known as a supersensitization. However, the sensitizing dye group which is selected to provide the combination for supersensitization is required to have a remarkable selectivity for each other and even a slight difference in chemical structures of sensitizing dyes greatly affects the supersensitizing action. Accordingly, the combination of sensitizing dyes exhibiting supersensitizing action cannot be predicted simply from the chemical structures of sensitizing dyes.

Various combinations of sensitizing dyes for increasing the sensitivity of silver halide photographic emulsions by such supersensitization have been reported. Of these combinations, the combination described in Japanese Patent Publication No. 50,324/83 is excellent for providing a silver halide photographic emulsion having a high sensitivity with reduced fog. However, when this combination is applied to obtaining recent super high-speed color photographic materials, the sensitivity obtained is insufficient.

SUMMARY OF THE INVENTION

An object of this invention is to provide a silver halide photographic emulsion having a very high spectral sensitivity in the green-sensitive spectral region.

Another object of this invention is to provide a silver halide photographic emulsion having a very high sensitivity and reduced fog.

As the result of various investigations, the inventors have discovered that these and other objects of the present invention can be attained by a light-sensitive silver halide photographic emulsion containing light-sensitive silver halide, a binder and a combination of at least one sensitizing dye represented by the following general formula (I), at least one sensitizing dye represented by the following general formula (II), and at least one sensitizing dye represented by the following general formula (III);

General formula (I)

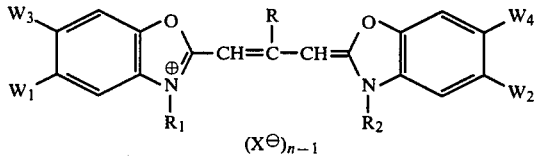

wherein $R_1$ and $R_2$ each represents a substituted or unsubstituted alkyl group, at least one of $R_1$ and $R_2$ being a sulfoalkyl group or a carboxyalkyl group; R represents an alkyl group or an aralkyl group; $W_1$, $W_2$, $W_3$ and $W_4$, which may be the same or different, each represents a hydrogen atom, a halogen atom, an aryl group, an alkyl group, a substituted alkyl group, an alkoxy group, an alkoxycarbonyl group, a carboxy group, or a hydroxy group, provided that $W_1$ and $W_2$ are not both a phenyl group; $X^{\ominus}$ represents an acid anion; and n represents 1 or 2, n being 1 when the sensitizing dye forms an intramolecular salt; the alkyl group and the alkyl residue represented by $R_1$, $R_2$, R, $W_1$, $W_2$, $W_3$ and $W_4$ having from 1 to 4 carbon atoms;

General formula (II)

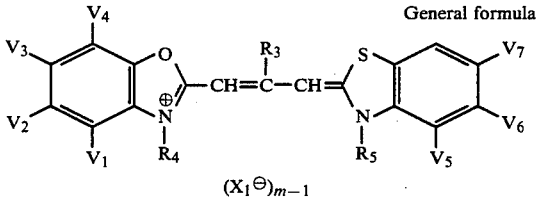

wherein $R_4$ and $R_5$ each represents a substituted or unsubstituted alkyl group, at least one of $R_4$ and $R_5$ being a sulfoalkyl group or a carboxyalkyl group; $R_3$ represents an ethyl group, a propyl group, or an aralkyl group, preferably an ethyl group, a propyl group, a benzyl group or a phenethyl group; $V_1$, $V_2$, $V_3$, $V_4$, $V_5$, $V_6$ and $V_7$, which may be the same or different, each represents a hydrogen atom, a halogen atom, an aryl group, an alkyl group, a substituted alkyl group, an alkoxy group, an alkoxycarbonyl group, a carboxy group, or a hydroxy group, provided that any of $V_1$ and $V_2$, $V_2$ and $V_3$, $V_3$ and $V_4$, $V_5$ and $V_6$ or $V_6$ and $V_7$ may combine to form a benzene ring; $X_1^{\ominus}$ represents an acid anion; and m represents 1 or 2, m being 1 when the sensitizing dye forms an intramolecular salt; the alkyl group and the alkyl residue represented by $R_4$, $R_5$, $R_3$, $V_1$, $V_2$, $V_3$, $V_4$, $V_5$, $V_6$ and $V_7$ having form 1 to 4 carbon atoms:

General formula (III)

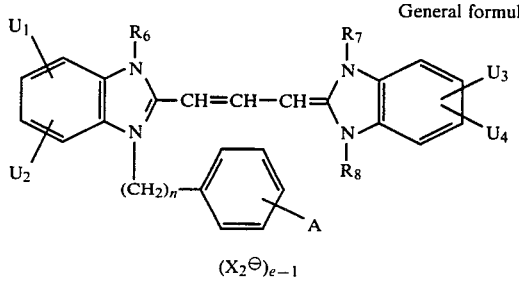

wherein $R_6$, $R_7$, and $R_8$, which may be the same or different, each represents an aliphatic group; $U_1$, $U_2$, $U_3$, and $U_4$, which may be the same or different, each represents a hydrogen atom, a halogen atom, an aliphatic hydrocarbon group, an acyl group, an acyloxy group, an alkoxycarbonyl group, a carbamoyl group, a sulfamoyl group, a cyano group, a trifluoromethyl group, or a hydroxy group; A represents a sulfo group or a carboxy group; $X_2^{\ominus}$ represents an acid anion; h represents an integer of 1 to 6 (preferably 1 to 4); and e represents 1 or 2.

DESCRIPTION OF THE PREFERRED EMBODIMENT

Then, the sensitizing deys for use in this invention are explained in detail.

In general formulae (I), (II) and (III) described above, $R_1$ and $R_2$ represent an alkyl group (e.g., a methyl group, an ethyl group, a propyl group, or a butyl group), a substituted alkyl group such as a hydroxyalkyl group (e.g., a 2-hydroxyethyl group, a 3-hydroxypropyl group or a 4-hydroxybutyl group), a carboxyalkyl group (e.g., a carboxymethyl group, a 4-carboxybutyl group or a 2-(2-carboxyethoxy)ethyl group), a sulfoalkyl group (e.g., a 2-sulfoethyl group, a 3-sulfopropyl group, a 3-sulfobutyl group, a 4-sulfobutyl group, a 2-(3-sulfopropoxy)ethyl group, a 2-hydroxy-3-sulfopropyl group, a 3-sulfopropoxyethoxyethyl group, a 2-acetoxy-3-sulfopropyl group or a 3-methoxy-2-(3-sulfopropoxy)propyl group), a vinylmethyl group, an aralkyl group (e.g., a benzyl group, a phenethyl group, a phenylpropyl group or a phenylbutyl group), and a substituted aralkyl group (e.g., a p-tolylpropyl group, a p-methoxyphenethyl group, a p-chlorophenethyl group, a p-sulfobenzyl group, a p-sulfophenethyl group, or a p-carboxybenzyl group). Among them, a substituted or unsubstituted lower alkyl group having 6 or fewer carbon atoms, is preferred, and the alkyl group substituted by at least one sulfo group is particularly preferred.

R represents an alkyl group in which each alkyl group and alkyl residue has from 1 to 4 carbon atoms (e.g., a methyl group, an ethyl group, a propyl group or a butyl group, etc.,), or an aralkyl group (e.g., a benzyl group, a phenethyl group, a phenylpropyl group or a phenylbutyl group), in which each alkyl group and alkyl residue has from 1 to 4 carbon atoms. Preferred examples of the group shown by R are an ethyl group, a phenethyl group or a benzyl group, with the ethyl group being most preferred.

$W_1$, $W_2$, $W_3$ and $W_4$ each represents a hydrogn atom, a halogen atom (e.g., fluorine atom, chlorine atom, bromine atom or iodine atom), an aryl group (e.g., a phenyl group), an alkyl group (e.g., a methyl group, an ethyl group, a propyl group, an isopropyl group or a butyl group), a substituted alkyl group (e.g., a trifluoromethyl group), an alkoxy group (e.g., a methoxy group, an ethoxy group, or a propoxy group), an alkoxycarbonyl group (e.g., a methoxycarbonyl group or an ethoxycarbonyl group), a carboxy group, or a hydroxy group, in which each alkyl group and alkyl residue has from 1 to 4 carbon atoms. $R_4$ and $R_5$ have the same definition as $R_1$ and $R_2$. Also, when $V_1$, $V_2$, $V_3$, $V_4$, $V_5$, $V_6$, and $V_7$ are substituted groups, they are substituted with the same substituents as $W_1$, $W_2$, $W_3$ and $W_4$ above. It is preferred that $W_1$ and $W_2$ are selected from a chlorine atom, a phenyl group, a methyl group, a methoxy group, and a trifluoromethyl group (especially a chlorine atom and a phenyl group) and that $W_3$ and $W_4$ are each a hydrogen atom.

$X^{\ominus}$, $X_1^{\ominus}$ and $X_2^{\ominus}$ each represents an acid anion such as an iodide ion, a bromide ion, a chloride ion, a p-toluenesulfonate ion, a benzenesulfonate ion, a sulfate ion, a perchlorate ion or a rhodanate ion, which are conventionally used for ordinary cyanine dye salts.

$U_1$, $U_2$, $U_3$ and $U_4$ each represents a hydrogen atom, a halogen atom (e.g., chlorine atom, fluorine atom or bromine atom), an aliphatic hydrocarbon group having 6 or fewer carbon atoms (e.g., a methyl group, an ethyl group, an allyl group or a cycloalkyl group), an acyl group having 8 or fewer carbon atoms (e.g., an acetyl group, a benzoyl group or a mesyl group), an acyloxy group having 3 or fewer carbon atoms (e.g., an acetoxy group), an alkoxycarbonyl group having 8 or fewer carbon atoms (e.g., a methoxycarbonyl group, an ethoxycarbonyl group or a benzyloxycarbonyl group), a carbamoyl group (e.g., a carbamoyl group, an N,N-dimethylcarbamoyl group, a morpholinocarbonyl group or a piperidinocarbonyl group), a sulfamoyl group (e.g., a sulfamoyl group, an N,N-dimethylsulfamoyl group, a morpholinosulfonyl group or a piperidinosulfonyl group), a cyano group, a trifluoromethyl group, or a hydroxy group. Among them, a fluorinated lower alkyl group having 6 or fewer carbon atoms, a halogen atom; and a cyano group, especially a trifluoromethyl group, a chlorine atom, and a cyano group, are preferred.

$R_6$, $R_7$, and $R_8$ each represents a lower aliphatic group having 6 or fewer carbon atoms (e.g., a methyl group, an ethyl group, an allyl group, a cyclohexyl group), or a substituted alkyl group. The substituted alkyl group includes, e.g., an alkyl group having 6 or fewer carbon atoms substituted by any of a carboxy group, a sulfo group, a cyano group, a halogen atom (e.g., fluorine atom, chlorine atom or bromine atom), a hydroxy group, an alkoxycarbonyl group having 8 or fewer carbon atoms (e.g., a methoxycarbonyl group, an ethoxycarbonyl group or a benzyloxycarbonyl group), an alkoxy group having 7 or fewer carbon atoms (e.g., a methoxy group, an ethoxy group or a benzyloxy group), a monocyclic aryloxy group (e.g., a phenoxy group or a p-tolyloxy group), an acyloxy group having 3 or fewer carbon atoms (e.g., an acetyloxy group or a propionyloxy group), an acyl group having 8 or fewer carbon atoms (e.g., an acetyl group, a propionyl group, a benzyl group or a mesyl group), a carbamoyl group (e.g., a carbamoyl group, an N,N-dimethylcarbamoyl group, a morpholinocarbonyl group or a piperidinocarbonyl group), a sulfamoyl group (e.g., a sulfamoyl group, an N,N-dimethylsulfamoyl group, a morpholinosulfonyl group or a piperidinosulfonyl group) or a monocyclic or dicyclic aryl group (e.g., a phenyl group, a p-hydroxyphenyl group, a p-carboxyphenyl group, a p-sulfophenyl group or an α-naphthyl group).

$V_1$, $V_2$, $V_3$, $V_4$, $V_5$, $V_6$, and $V_7$ are each preferably a hydrogen atom, a phenyl group, or a lower alkoxy group having 6 or fewer carbon atoms; $R_3$ is preferably a lower alkyl group, particularly preferably an ethyl group; $R_4$ and $R_5$ are each preferably a substituted or unsubstituted lower alkyl group having 6 or fewer carbon atoms, particularly preferably a lower alkyl group substituted by at least one sulfo group; $R_6$ is preferably a lower alkyl group having 6 or fewer carbon atoms; $R_7$ and $R_8$ are each preferably a substituted or unsubstituted lower alkyl group having 6 or fewer carbon atoms, particularly preferably a lower alkyl group substituted by at least one sulfo group; and A is preferably a sulfo group.

Specific examples of each of the sensitizing dyes (I), (II) and (III) for use in this invention are described below, but the sensitizing dyes for use in this invention are not limited to these dyes.

Specific examples of the dye shown by general formula (I):

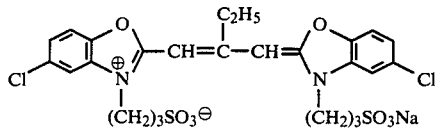
I-1

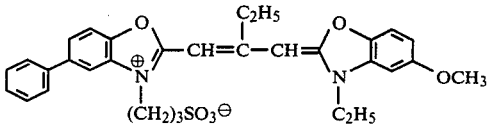
I-2

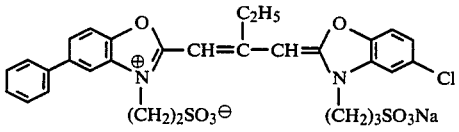
I-3

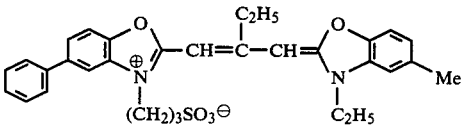
I-4

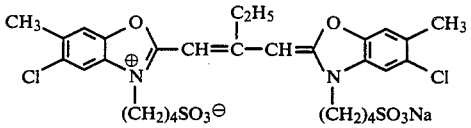
I-5

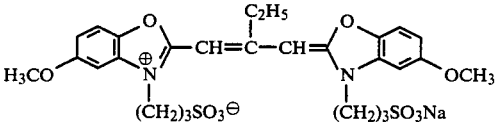
I-6

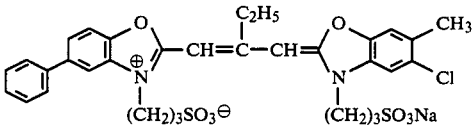
I-7

-continued

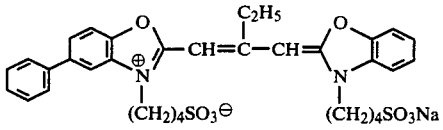
I-8

Specific examples of the dyes shown by general formula (II):

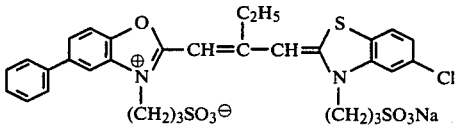
II-1

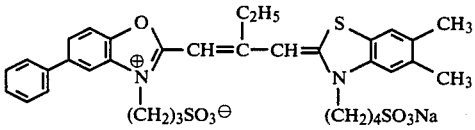
II-2

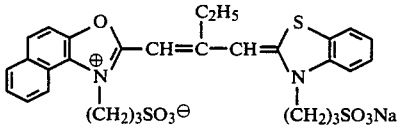
II-3

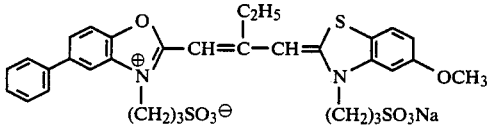
II-4

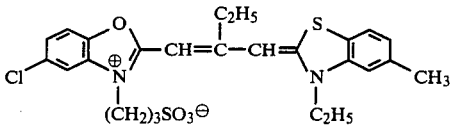
II-5

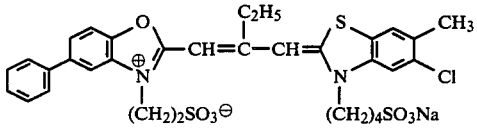
II-6

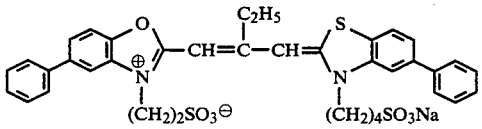
II-7

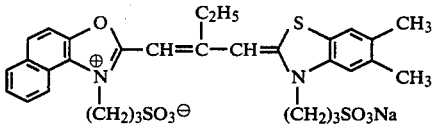
II-8

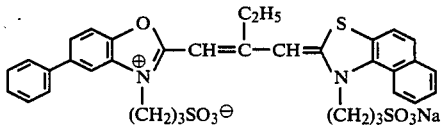
II-9

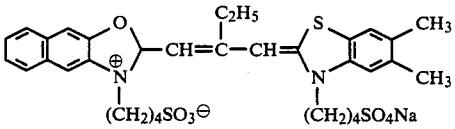
II-10

-continued
II-11
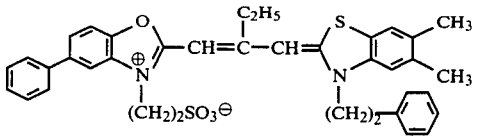
II-12
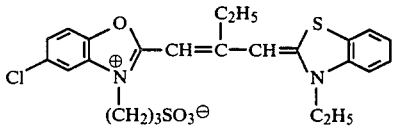
II-13
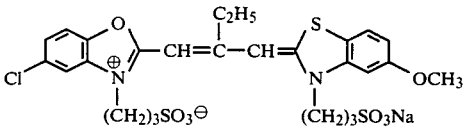
II-14
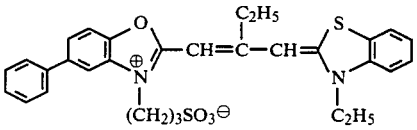
Specific examples of the dyes shown by general formula (III):
III-1
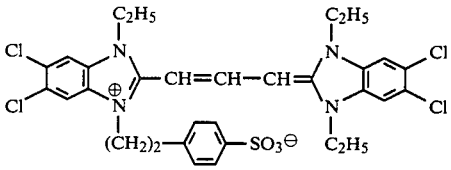
III-2
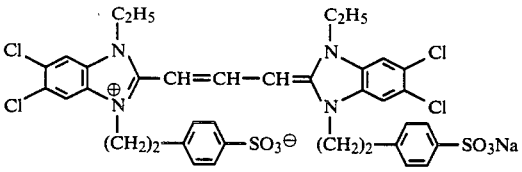
III-3
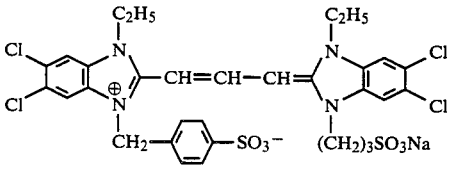
III-4
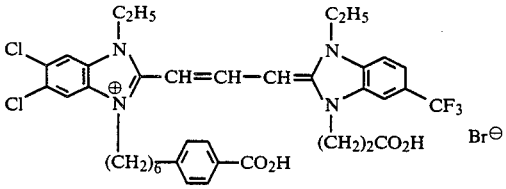
III-5
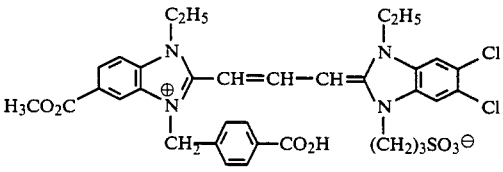
-continued
III-6
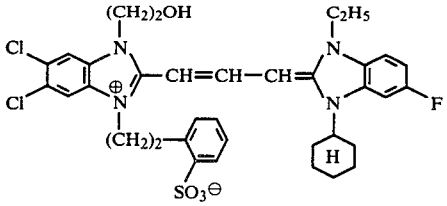
III-7
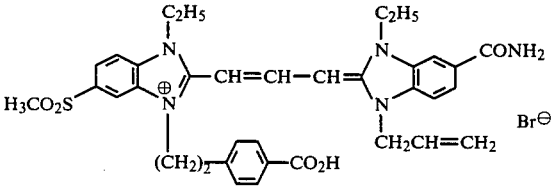
III-8
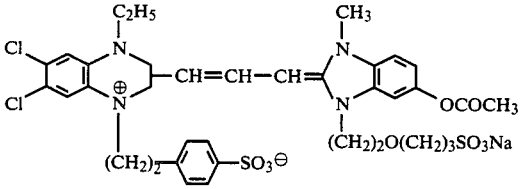
III-9
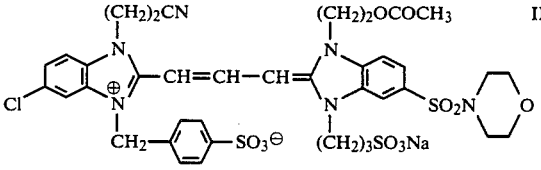
III-10
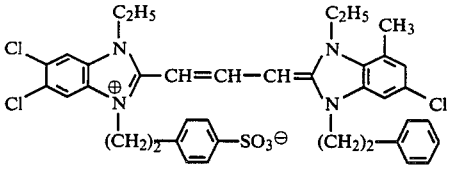
III-11
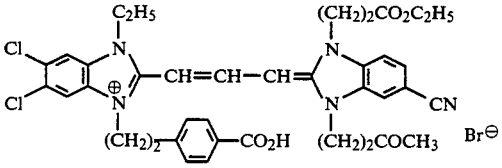
III-12
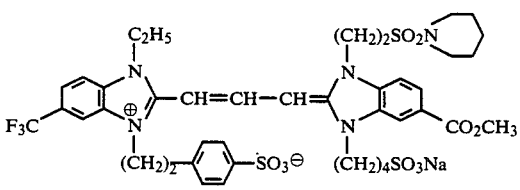
III-13
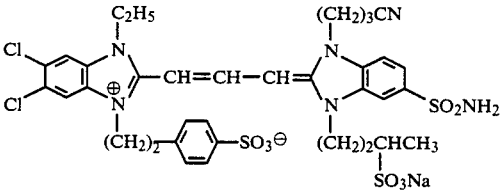

-continued

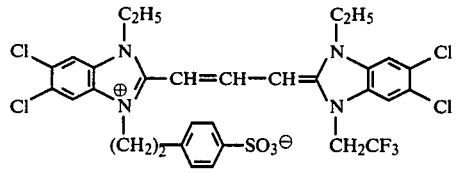

III-14

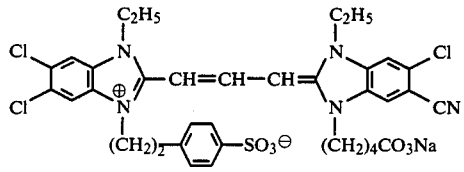

III-15

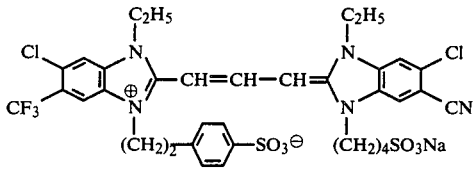

III-16

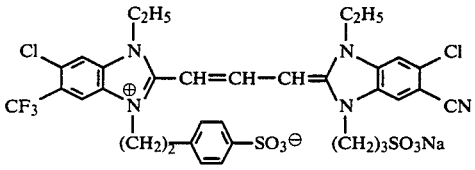

III-17

The sensitizing dyes for use in this invention are known (e.g., the dyes represented by general formulae (I) and (II) are described in, for example, U.S. Pat. No. 4,362,813, and the dyes represented by general formula (III) are described in, for example, U.S. Pat. No. 4,179,296) and can be easily prepared by known methods as described in, for example, F. M. Homes, *The Cyanine Dyes and Related Compounds* (Interscience Publishers, New York 1964) and *Research Disclosure,* Vol. 176, page 23, Paragraph IV (RD-17643, December, 1978).

Each of the sensitizing dyes shown by general formula (I), general formula (II) and general formula (III) is incorporated in a silver halide emulsion in an amount of about $1\times10^{-6}$ mole to $8\times10^{-3}$ mole, preferably about $3\times10^{-6}$ mole to $2.5\times10^{-3}$ mole, particularly preferably about $1\times10^{-3}$ mole per mole of the silver halide in the silver halide photographic emulsion.

The molar ratio of the dye shown by general formula (II) to the dye shown by general formula (I) is preferably about 1:30 to 10:1, particularly preferably about 1:20 to 2:1. The molar ratio of the dye shown by general formula (III) to the dye shown by general formula (I) is preferably about 1:10 to 10:1, particularly preferably about 1:5 to 5:1.

Furthermore, the silver halide emulsion of this invention may contain another sensitizing dye or dyes in addition to the sensitizing dyes represented by general formulae (I), (II) and (III).

The sensitizing dyes for use in this invention may be added to a silver halide emulsion directly before coating the emulsion on a support but may be dispersed in the silver halide emulsion in any step of preparing silver halide emulsion. For example, the sensitizing dyes may be added to a silver halide emulsion before, during or after the formation of silver halide grains or may be added to a silver halide emulsion before, during or after the chemical sensitization of the silver halide emulsion.

The sensitizing dyes for use in this invention can be directly dispersed in a silver halide emulsion. Also, these sensitizing dyes each can be added to a silver halide emulsion as a solution thereof in a proper solvent such as methanol, ethanol, n-propanol, methyl cellosolve, acetone, water, pyridine, etc., or a mixture thereof.

Ultrasound can be used for dissolving the sensitizing dye. Furthermore, other methods of adding the sensitizing dyes include a method of dissolving the sensitizing dye in a volatile organic solvent, dispersing the solution in an aqueous solution of a hydrophilic colloid, and adding the dispersion to a silver halide emulsion as described in U.S. Pat. No. 3,469,987; a method of dispersing the water-insoluble sensitizing dye in a water-soluble solvent without dissolving the dye and adding the dispersion to a silver halide emulsion as described in Japanese Patent Publication No. 24,185/71; a method of dissolving the sensitizing dye in an aqueous solution of a surface active agent and adding the solution to a silver halide emulsion as describec in U.S. Pat. No. 3,822,135; a method of dissolving the sensitizing dye using a compound for undergoing red-shifting and adding the solution to a silver halide emulsion as described in Japanese Patent Application (OPI) No. 74,624/76 (the term "OPI" as used herein indicates a "published unexamined Japanese patent application"); and a method of dissolving the sensitizing dye in an acid substantially containing no water and adding the solution to a silver halide emulsion as described in Japanese Patent Application (OPI) No. 80,826/75. Moreover, the methods described in U.S. Pat. Nos. 2,912,343, 3,342,605, 2,996,287, and 3,429,835 can be used for the addition of the sensitizing dyes to a silver halide emulsion.

The sensitizing dyes used in this invention can be added as a mixture of two or more kinds of the dyes or individually.

The sensitizing dyes for use in this invention can be further used together with an other sensitizing dye or dyes. Examples of such other sensitizing dyes which can be used together with the sensitizing dyes according to this invention are described in, for example, U.S. Pat. Nos. 3,703,377, 2,688,545, 3,397,060, 3,615,635, and 3,628,964; U.K. Pat. Nos. 1,242,588 and 1,293,862; Japanese Patent Publication Nos. 4936/68, 14,030/69, 10,773/68 and 4930/68; and U.S. Pat. Nos. 3,416,927, 3,615,613, 3,615,632, 3,617,295 and 3,635,721.

The silver halide emulsion of this invention is typically prepared by mixing an aqueous water-soluble silver salt (e.g., silver nitrate) and an aqueous solution of a water-soluble halide (e.g., potassium bromide) in the presence of an queous solution of a water-soluble polymer such as gelatin. As the silver halide, silver chloride, silver bromide, as well as a mixed silver halide such as silver chlorobromide, silver iodobromide or silver chloroiodobromide can be used. Among them, silver iodobromide (having preferably an iodide content at 3 to 15 mole%) is preferred.

The mean grain size (i.e., the diameter of grains when the grain is a spherical grain or a generally spherical grain, and a mean value based on the projected areas using the long side length as the grain size when the grain is a cubic grain) is preferably less than about 4μ. The distribution of the grain size may be narrow ("mono-dispersed") or broad.

The form of the silver halide grains may be a cubic form, a tetrahedron, a rhombic dodecahedron, an octahedron, a mixed crystal form of these forms, or a spherical form or a tubular form.

A silver halide emulsion containing silver halide grains of tubular form wherein the diameter of the grain is more than 5 times the thickness thereof in a proportion of more than 50% of the whole projection areas can be used. Detailed descriptions of such silver halide emulsions are provided in Japanese Patent Application (OPI) Nos. 127,921/83 and 113,927/83.

Two or more kinds of silver halide photographic emulsions prepared separately may be used as a mixture thereof. Furthermore, the silver halide grains for use in this invention may have uniform crystal structure throughout the grains or may have different layer structures in the inside and the outside of the grains. The silver halide emulsion may be a "conversion-type" emulsion described in U.K. Pat. No. 635,841 and U.S. Pat. No. 3,622,318. The silver halide grains may be a type mainly forming a latent image at the their surface or a type forming a latent image in the inside of the grains.

These silver halide photographic emulsions can be prepared by conventional methods, including those described in James, *The Theory of the Photographic Process* (MacMillan Co., 4th ed. 1976); P. Grafkides, *Chimie et Photographique* (Paul Montel Co. 1957), G. F. Duffin, *Photographic Emulsion Chemisty* (The Focal Press, 1966); and V. L. Zelikman et al, *Making and Coating Photographic Emulsion* (The Focal Press, 1964).

That is, the silver halide emulsion can be prepared by an acid process, a neutral process, or an ammonia process. For reacting a water-soluble silver salt and a water-soluble halide, a single jet mixing method, a double jet mixing method, or a combination of the two can be employed.

Also, the "back mixing" method of forming silver halide grains in the presence of excess silver ions can be employed.

As one double jet mixing method, a method of maintaining constant pAg in a liquid phase in which a silver halide is formed, that is, the "controlled double jet" method can be used to produce a silver halide emulsion containing silver halide grains having a regular crystal form and almost uniform grain size.

The silver halide grains may be formed or physically ripened in the presence of a cadmium salt, zinc salt, a lead salt, a thallium salt, an iridium salt or a complex salt thereof, a rhodium salt or a complex salt thereof, an iron salt or a complex salt thereof, etc.

Also, in the formation of the silver halide grains, a silver halide solvent can be used for controlling the growth of the silver halide grains. Examples of such silver halide solvents are ammonia, potassium rhodanide, thioether compounds (described in, for example, U.S. Pat. Nos. 3,271,157, 3,574,628, 3,704,130, 4,297,439 and 4,276,374), thione compounds (described in, for example, Japanese Patent Application (OPI) Nos. 144,319/78, 82,408/78 and 77,737/80), and amine compounds (described in, for example, Japanese Patent Application (OPI) No. 100,717/79).

The silver halide emulsion may be used as a so-called primitive emulsion, i.e., a silver halide emulsion that is not chemically sensitized but is usually chemically sensitized. For chemical sensitization, the method described in H. Frieser, *Die Grundlagen der Photographischen Prozesse mit Silberhalogeniden,* (Akademische Verlagsgesellshcaft, 1968) can be used.

Suitable chemical sensitization methods useful in the present invention include a sulfur sensitization method using active gelatin and a sulfur-containing compound capable of reacting with silver (e.g., a thiosulfate, a thiourea, a mercapto compound or a rhodanine), a reduction sensitization method using a reducing material (e.g., a stannous salt, an amine, a hydrazine derivative, formamidinesulfinic acid or a silane compound), and noble metal sensitization method using a noble metal compound (e.g., a gold compound and a complex salt of a metal blonging to group VIII of the periodic table, such as platinum, iridium or palladium). These mehtods can be used individually or in combination.

The silver halide emulsions of this invention may contain a sensitizer such as polyoxyethylene derivatives (as described in, for example, U.K. Pat. No. 981,470, Japanese Patent Publication No. 6475/56 and U.S. Pat. No. 2,716,062), polyoxypropylene derivatives, and derivatives having a quaternary ammonium group.

The silver halide phtographic emulsions of this invention may further contain various compounds for preventing the formation of fog during producing, storing, or processing photographic materials containing the photographic emulsions or for stabilizing the photographic performance of the photographic materials. Examples of the anitifoggants or stabilizers which can be used for these purposes include azoles such as benzothiazolium salts, nitroimidazoles, nitrobenzimidazoles, chlorobenzimidazoles, bromobenzimidazoles, nitroindazoles, benzotriazoles, and aminotriazoles; mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole), mercaptopyrimidines, and mercaptotriazines; thioketo compounds such as oxazolinethione; azaindenes such as triazaindenes and tetraazaindenes (in particular, 4-hydroxy-substituted (1,3,3a,7)tetraazaindenes) and pentaazaindenes; benzenethiosulfonic acid; benzenesulfinic acid; and benzenesulfonic acid amide.

More detailed specific examples of these additives and methods for their use are described in, for example, U.S. Pat. Nos. 3,954,474 and 3,982,947, and Japanese Patent Publication No. 28,660/77.

As a binder or a protective colloid which can be used for the silver halide emulsions of this invention and other photographic layers of the photographic materials containing the silver halide emulsions of this invention, gelatin is advantageously used but other hydrophilic colloids can be used.

Examples of such hydrophilic colloids include gelatin derivatives; graft polymers of gelatin and other macromolecular compounds; proteins such as albumin and casein; sugar derivatives such as cellulose derivatives, e.g., hydroxyethyl cellulose, carboxymethyl cellulose and cellulose sulfate esters, sodium alginate, and starch derivatives; and various synthetic hydrophilic polymers such as homopolymers and copolymers, e.g., polyvinyl alcohol, polyvinyl alcohol partial acetal, poly-N-vinylpyrrolidone, polyacrylic acid, polymethacrylic acid, polyacrylamide, polyvinyl imidazole and polyvinyl pyrazole.

As gelatin, limed gelatin or acid-treated gelatin and enzyme-treated gelatin as described in *Bull. Soc. Sci. Phot. Japan,* No. 16, 30 (1966) can be used. The silver halide emulsions of this invention may contain an inorganic or organic hardening agent such as, for example, chromium salts (e.g., chromium alum or chromium acetate), aldehydes (e.g., formaldehyde, glyoxal or glutaraldehyde), N-methylol compounds (e.g., dimethylolurea or methyloldimethylhydantoin), dioxane derivatives (e.g., 2,3-dihydroxydioxane), active vinyl compounds (e.g., 1,3,5-triacryloyl-hexahydro-s-triazine or 1,3-vinylsulfonyl-2-propanol), active halogen compounds (e.g., 2,4-dichloro-6-hydroxy-s-triazine), and mucohalogenic acids (e.g., mucochloric acid or mucophenoxychloric acid). These hardening agents can be used individually or in combination.

The silver halide photographic materials of this invention may further contain various surface active agents as a coating air or for improving antistatic properties, slipping properties, dispersibility, sticking prevention, and photographic characteristics (e.g., acceleration of development, increase of contrast or sensitization).

Examples of suitable surface active agents include nonionic surface active agents suh as saponin (steroid series), alkylene oxide derivatives (e.g., polyethylene glycol, a polyethylene glycol/polypropylene glycol condensation product, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides and polyethylene oxide addition products of silicone), glycidol derivatives (e.g., alkenylsuccinic acid polyglycerides and alkylphenol polyglycerides), fatty acid esters of polyhydric alcohols and alkyl esters of sugar; anionic surface active agents having an acid group (e.g., a carboxy group, a sulfo group, a phospho group, a sulfuric acid ester group or a phosphoric acid ester group), such as alkylcarboxylates, alkylsulfonates, alkylbenzenesulfonates, alkylnaphthalenesulfonates, alkylsulfuric acid esters, alkylphosphoric acid esters, N-acyl-N-alkyltaurins, sulfosuccinic acid esters, sulfoalkyl polyoxyethylene alkylphenyl ethers and polyoxyethylene alkylphosphoric aid esters; amphoteric surface active agents such as amino acids, aminoalkylsulfonic acids, aminoalkylsulfuric acid esters, aminoalkylphosphoric acid esters, alkylbetaines and amine oxides; and cationic surface active agents such as alkylamine salts, aliphatic or aromatic quaternary ammonium salts, heterocyclic quaternary ammonium salts (e.g., pyridiniums and imidazoliums) and phosphonium or sulfonium salts containing aliphatic rings or hetercyclic rings.

The silver halide photographic emulsions of this invention may further contain polyalkylene oxides, polyalkylene oxide derivatives (e.g., the ethers, esters and amines of polyalkylene oxide), thioether compounds, thiomorpholines, quaternary ammonium salt compounds, urethane derivatives, urea derivatives, imidazole derivatives and 3-pyrazolidone derivatives.

The hydrophilic colloid layers of photographic materials prepared using the silver halide photographic emulsions of this invention may contain water-soluble dyes as filter dyes, irradiation preventing dyes, or for other purposes. Such dyes include oxonol dyes, merocyanine dyes, hemioxonol dyes, styryl dyes, merocyanine dyes, cyanine dyes, and azo dyes. Among them, oxonol deys, hemioxonol dyes and merocyanine dyes are useful.

The photographic materials prepared using the silver halide photographic emulsions of this invention may contain in the photographic emulsion layers or other hydrophilic colloid layers a whitening agent such as a stilbene series compound, a triazine series compound, an oxazole series compound or a cumarine series compound. Also, a water-insoluble whitening agent may be used as a dispersion.

The photographic materials prepared using the silve halide emulsions may further contain in the photographic emulsion layers and other hydrophilic colloid layers a dispersion of a water-insoluble or sparingly water-soluble synthetic polymer for improving the dimensional stability of these layers. Examples of these synthetic polymers include polymers or copolymers composed of monomer components such as an alkyl (meth)acrylate, an alkoxyalkyl (meth)acrylate, glycidyl (meth)acrylate, (meth)acrylamide, a vinyl ester (e.g., vinyl acetate), acrylonitrile, olefins or styrene, alone or in combination or further in combination with acrylic acid, methacrylic acid, $\alpha,\beta$-unsaturated dicarboxylic acid, hydroxyalkyl (meth)acrylate, sulfoalkyl (meth)acrylate or styrenesulfonic acid.

The silver halide emulsions of this invention may contain dye image-forming couplers, i.e., compounds capable of forming a colored dye by an oxidative coupling reaction with an aromatic primary amine color developing agent (e.g., phenylenediamine derivatives or aminophenol derivatives) in a color development process. It is preferred that the coupler is a non-diffusible coupler having a hydrophobic group called a "ballast group" in the molecule, or a polymer coupler. The coupler may be four equivalent or two equivalent to silver ion. Also, the silver halide emulsions of this invention may contain colored couplers having a color correction effect, "DIR coupler", i.e., couplers releasing a development inhibitor with the progress of development, or "DAR couplers" or "FR couplers", i.e., couplers releasing a development accelerator or a fogging agent. Furthermore, the silver halide emulsions of this invention may contain non-coloring DIR coupling compounds which form a colorless coupling reaction product and release a development inhibitor.

Examples of DIR couplers that can be used in the silver halide emulsion according to the invention are magenta couplers such as 5-pyrazolone couplers, pyrazolobenzimidazole couplers, cyanoacetylcumarone couplers, closed chain acetoanilide couplers and pyrazoloazole couplers; yellow couplers such as acetylacetanilide couplers (e.g., benzylacetanilides and pivaloylacetanilides); and cyan couplers such as naphthol couplers and phenol couplers.

Also, the silver halide photographic emulsions may contain magenta couplers which may be four equivalent or two equivalent to silver ion, and preferably two equivalent.

Specific examples of magenta coloring couplers are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, and 3,891,445, West German Pat. No. 1,810,464, West German Patent Application (OLS) Nos. 2,408,665, 2,417,945, 2,418,959, and 2,424,467, Japanese Patent Publication No. 6031/65, Japanese Patent Application (OPI) Nos. 20,826/76, 58,922/77, 129,538/74, 74,027/74, 159,336/75, 42,121/77, 74,028/74, 60,233/75, 26,541/76, and 55,122/78, and Japanese Patent Application Nos. 121,689/79, 136,497/79, 163,167/79, 163,168/79, and 31,320/80.

Two or more of the above-described couplers may be present in one silver halide emulsion layer or the same compound may be present in two or more silver halide emulsion layers.

For introducing the coupler into the silver halide emulsion layer, any known method, such as those described in, for example, U.S. Pat. No. 2,322,027 can be used.

For example, the coupler can be dissolved in a high boiling coupler such as a phthalic acid alkyl ester (e.g., dibutyl phthalate or dioctyl phthalate), a phosphoric acid ester (e.g., diphenyl phosphate, triphenyl phosphate, tricresyl phosphate or dioctylbutyl phosphate), a citric acid ester (e.g., tributyl acetylcitrate), a benzoic acid ester (e.g., octyl benzoate), an alkylamide (e.g., diethyl laurylamide), a fatty acid ester (e.g., dibutoxyethyl succinate or diethyl azerate), or a trimesic acid ester (e.g., tributyl trimesate), or a low boiling organic solvent such as a lower alkyl acetate (e.g., ethyl acetate or an butyl acetate), ethyl propionate, secondary butyl alcohol, methyl isobutyl ketone, $\beta$-ethoxyethyl acetate or methyl cellosolve acetate, and then dispersed in an aqueous solution of a hydrophilic colloid as a solution thereof. A mixture of a high boiling organic solvent and low boiling organic solvent may be used for the above purpose.

It is convenient to select the dye-forming couplers so that an intermediate scale image is obtained. It is preferred that the maximum absorption region of the cyan dye formed from the cyan-forming coupler is between about 600 nm and about 720 nm, and the maximum absorption region of the magenta dye formed by the magenta-forming coupler is between about 500 nm and about 580 nm, and the maximum absorption region of the yellow dye formed from the yellow-forming coupler is between about 400 nm and about 480 nm.

The photographic materials prepared using the silver halide photographic emulsions according to the invention may further contain ultraviolet absorbents in their hydrophilic colloid layers. Example of such ultraviolet absorbents are aryl-substituted benzotriazole compounds (as described in, for example, U.S. Pat. No. 3,533,794), 4-thiazolidone compounds (as described in, for example, U.S. Pat. Nos. 3,314,794 and 3,352,681), benzophenone compounds (as described in, for example, Japanese Patent Application (OPI) No. 2784/71), cinnamic acid ester compounds (as described in, for example, U.S. Pat. Nos. 3,705,805 and 3,707,375), butadiene compounds (as described in, for example, U.S. Pat. No. 4,045,229), and benzoxidole compounds (as described in, for example, U.S. Pat. No. 3,700,455). Furthermore, the ultraviolet absorbents described in U.S. Pat. No. 3,499,762 and Japanese Patent Application (OPI) No. 48,535/79 can be used. Moreover, ultraviolet absorptive couplers (e.g., $\alpha$-naphtholic cyan dye-forming couplers) and ultraviolet absorptive polymers may be used. These ultraviolet absorbents may be mordanted to specific photographic layers.

For the photographic materials prepared using the silver halide emulsions of this invention, fading preventing agents may be used. Examples of these fading preventing agents include hydroquinone derivatives, gallic acid derivatives, aminophenol derivatives and ascorbic acid derivatives.

Details of the above-described various additives are described in *Research Disclosure,* No. 176, pages 22–31 (RD-17643, Dec., 1978).

The finished silver halide emulsion of this invention can be coated on a proper conventional support such as a baryta-coated paper, a resin-coated paper, a synthetic paper, a cellulose triacetate film, a polyethylene terephthalate film or other plastic bases, a glass plate, etc., by a conventional coating method such as a dip coating method, an air knife coating method, a curtain coating method, or an extrusion coating method using a hopper described in U.S. Pat. No. 2,681,294.

The support may be transparent or opaque according to the purpose of the photographic material. When a transpatent support is used, it may be colorless or may be colored by the addtion of a dye or pigment.

The light source used for obtaining photographic images by exposing the silver halide emulsions according to the invention may be any ordinary light sourse. For example, various light sources such as natural light (sunlight), a tungsten lamp, a fluorescent lamp, a mercury lamp, a xenon arc lamp, a carbon arc lamp, a xenon flash lamp, a cathode ray flying spot, etc., can be used. The exposure time may be about 1/1000 sec. to 1 sec as used for an ordinary camera but may be shorter than 1/1000 sec., for example, $1/10^4$ sec. to $1/10^6$ sec. when using a xenon flash lamp or a cathode ray tube as the light source or may be longer than 1 sec. If desired, the spectral composition of light which is used for the light exposure can be controlled by using color filters. Laer light can be used for the exposure as well as light emitted from a fluorescent screen excited by electron beams, X-rays, gamma rays or $\alpha$-rays.

The silver halide photographic emulsion of this invention can be used in various kinds of color photographic materials and black and white photographic materials. Examples of these photographic materials include color negative photographic films (general color films or cinne color films), color reversal photographic films (color reversal films for slide, color reversal cinne films, or color reversal films containing no couplers), color photographic papers, color positive photographic films (cinne films), color reversal photographic papers, color photographic materials for heat development, color photographic materials for a silver dye bleaching process, photographic materials for printing plates (lithographic light-sensitive films or scanner light-sensitive films), X-ray photographic materials (direct medical X-ray films, indirect medical X-ray films or industrial X-ray films), black and white negative photographic films, black and white photographic papers, micro photographic materials (photographic materials for computer output microfilm (COM) or microfilms), color diffusion transfer photographic materials (DTR), silver salt diffusion transfer photographic materials and printout photographic materials.

The photographic materials prepared using the silver halide photographic emulsions of this invention can be processed by using known processes and known processing solutions. The processing temperature is usually selected between about 18° C. and 50° C. but may be lower than 18° C. or higher than 50° C.

According to purpose, a black and white photographic process for forming silver images or a color photographic process for forming dye images can be employed.

A black and white developer contains a developing agent such as a dihydroxybenzene (e.g., hydroquinone), a 3-pyrazolidone (e.g., 1-phenyl-3-pyrazolidone) or an aminophenol (e.g., N-methyl-p-aminophenol) and these developing agents may be used alone or in combination.

A color developer for a color photographic process is generally composed of an alkaline aqueous solution containing a color developing agent. Such color developing agents include aromatic primary amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline and 4-amino-3-methyl-N-ethyl-N-β-methoxyethylaniline).

Other examples of suitable color developing agents are described in L. F. A. Mason, *Photographic Processing Chemistry,* pages 226–229, (Focal Press, 1966); U.S. Pat. Nos. 2,193,015 and 2,592,364 and Japanese Patent Application (OPI) No. 64,933/73.

The developers may further contain pH buffers such as the sufides, carbonates, borates, and phosphates of alkali metals; or development inhibitors or antifoggants such as bromides, iodides, and organic antifoggants. Also, if necesssary, the developers may further contain water softeners; preservatives such as hydroxylamine; organic solvents such as benzyl alcohol or diethylene glycol; development accelerators such as polyethylene glycol, quaternary ammonium salts or amines; dye-forming couplers; competing couplers; fogging agents such as sodium borohydride; auxiliary developing agents such as 1-phenyl-3-pyrazolidone; tackifiers; polycarboxylic acid series chelating agents described in U.S. Pat. No. 4,083,723; or the antioxidants described in West German Patent Application (OLS) No. 2,622,950.

In a color photographic process, the photographic material is usually bleached after color development. The bleach process may be performed simultaneously with a fix process or separately from a fix process.

Examples of a bleaching agent are compounds of multivalent metals such as iron(III), cobalt(III), chromium(VI), and copper(II); peracids; quionones; and nitroso compounds, including, e.g., ferricyanides; dichromates; organic complex salts of iron(III) or cobalt(III); aminopolycarboxylic acids such as ethylenediaminetetraacetic acid, nitrilotriacetic acid and 1,3-diamino-2-propanoltetraacetic acid; complex salts of organic acids such as citric acid, tartaric acid and malic acid; persulfates, permanganates; and nitrosophenol. Of these compounds, potassium ferricyanide, ethylenediaminetetraacetic acid iron(III) sodium and ethylenediaminetetraacetic acid iron(III) ammonium are particularly advantageous. Ethylenediaminetetraacetic acid iron(III) complex salts can be advantageously used for a bleach solution and a blix solution.

The bleach solutions or blix solutions may further contain various additives such as the bleach accelerators described in U.S. Pat. Nos. 3,042,520 and 3,241,966, Japanese Patent Publication Nos. 8506/70 and 8836/70 and Japanese Patent Application (OPI) No. 95,630/78; and the thiol compounds described in Japanese Patent Application (OPI) No. 65,632/78.

Specific embodiments of the present invention are illustrated by the following examples, but the present invention is not to be construed as being limited thereto. Unless otherwise indicated, all parts, percents and ratios are by weight.

EXAMPLE 1

Silver halide grains were precipitated by a double jet method and the silver halide emulsion was subjected to physical ripening, desalting, and then chemical ripening to provide a silver iodobromide emulsion (iodine content of 7 mole%). The mean grain size of the silver halide grains contained in the emulsion was 0.8 micron, and the silver halide emulsion contained 0.52 mole of silver halide per 1 kg of the emulsion.

One kilogram (1 kg) of the emulsion was placed in a pot and heated to 40° C. and after adding thereto a definite amount of a 0.2% methanol solution of a sensitizing dye or sensitizing dyes as shown in Table 1 and Table 2 below, the mixture was stirred. Furthermore, 10 ml of an aqueous solution of 1.0% by weight 4-hydroxy-6-methyl-1,3,3a,7-tetraazaindene, 10 ml of an aqueous solution of 1.0% by weight 1-hydroxy-3,5-dichlorotriazine sodium salt, and then 10 ml of an aqueous solution of 1.0% by weight sodium dodecylbenzenesulfonate were added to the mixture and the resultant mixture was stirred to produce a silver halide emulsion.

The finished silver halide emulsion was coated on a cellulose triacetate film base at a dry thickness of 5 microns and dried to provide each sample of black and white photographic material.

The film samples were exposed through an optical wedge with a yellow filter (SC-50) made by Fuji Photo Film Co., Ltd. using an actinometer having a light source with a color temperature of 5400° K. After exposure, each sample was developed using a developer having the composition shown below for 3 minutes at 20° C. and after stopping (using a one liter aqueous solution containing 50 ml of 7N $H_2SO_4$ at 20° C. for one minute) and fixing (using the same fix solution as used in Example 3 described below at 20° C. for 5 minutes), the sample was washed with water at 20° C. for 10 minutes to provide strips each having black and white images. The density of each sample was measured using a P-type densitomer made by Fuji Photo Film Co., Ltd. to determine sensitivity and fog. The standard of optical density used in determining the sensitivity was fog+0.20.

| Composition of Developer | |
|---|---|
| Water | 500 ml |
| N—Methyl-p-aminophenol | 2.2 g |
| Anhydrous Sodium Sulfite | 96.0 g |
| Hydroquinone | 8.8 g |
| Sodium Carbonate Monohydrate | 56.0 g |
| Potassium Bromide | 5.0 g |
| Water to make | 1 liter |

The results obtained are shown in Table 1 and Table 2 as relative values.

These results show that the combination of the sensitizing dyes according to this invention provides high sensitivity with reduced fog. From the results shown in Table 1, it can be seen that by using a combination of three sensitizing dyes in this invention, the relative sensitivity is greatly increased without increasing fog (Test Nos. 17 to 19) as compared with the case of using the sensitizing dyes alone or a combination of only two of the sensitizing dyes (Test Nos. No. 1 to No. 16). These results show that when comparison sensitizing dye A is used as the third sensitizing dye, the sensitivity is increased to some extent but the formation of fog is high and the silver halide emulsion is unsuitable for practical use. The results shown in Table 2 also show that the combined use of three sensitizing dyes according to this invention provides high sensitivity with reduced fog.

TABLE 1

| Test No. | | Sensitizing Dye and Amount ($\times 10^{-5}$ mole/kg-emulsion) | | | Relative Sensitivity | Fog |
|---|---|---|---|---|---|---|
| (Comparison) | 1 | I-3 10 | | | 100* | 0.03 |
| (Comparison) | 2 | I-3 20 | | | 153 | 0.03 |
| (Comparison) | 3 | I-3 40 | | | 151 | 0.03 |
| (Comparison) | 4 | | II-2 10 | | 162 | 0.03 |
| (Comparison) | 5 | | II-2 20 | | 190 | 0.03 |
| (Comparison) | 6 | | II-2 40 | | 190 | 0.03 |
| (Comparison) | 7 | | | III-16 10 | 121 | 0.03 |
| (Comparison) | 8 | | | III-16 20 | 180 | 0.03 |
| (Comparison) | 9 | | | III-16 40 | 179 | 0.03 |
| (Comparison) | 10 | I-3 10 | II-2 20 | | 303 | 0.03 |
| (Comparison) | 11 | I-3 20 | II-2 20 | | 324 | 0.03 |
| (Comparison) | 12 | | II-2 20 | III-16 10 | 308 | 0.03 |
| (Comparison) | 13 | | II-2 20 | III-16 20 | 332 | 0.03 |
| (Comparison) | 14 | | II-2 20 | III-16 40 | 332 | 0.03 |
| (Comparison) | 15 | I-3 10 | | III-16 20 | 292 | 0.03 |
| (Comparison) | 16 | I-3 20 | | III-16 20 | 317 | 0.03 |
| (This Invention) | 17 | I-3 20 | II-2 20 | III-16 10 | 354 | 0.03 |
| (This Invention) | 18 | I-3 20 | II-2 20 | III-16 20 | 396 | 0.03 |
| (This Invention) | 19 | I-3 20 | II-2 20 | III-16 40 | 397 | 0.03 |
| (Comparison) | 20 | | | A 10 | 117 | 0.05 |
| (Comparison) | 21 | | | A 20 | 166 | 0.06 |
| (Comparison) | 22 | | | A 40 | 166 | 0.06 |
| (Comparison) | 23 | I-3 20 | II-2 20 | A 10 | 328 | 0.06 |
| (Comparison) | 24 | I-3 20 | II-2 20 | A 20 | 346 | 0.07 |
| (Comparison) | 25 | I-3 20 | II-2 20 | A 40 | 346 | 0.07 |

*Standard

Comparison Sensitizing dye A
(Same as Dye A described in U.S. Pat. No. 3,397,060)

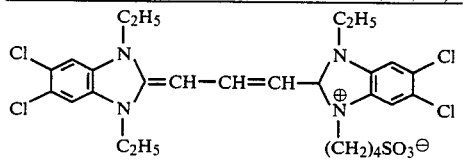

TABLE 2

| Test No. | | Sensitizing Dye and Amount ($\times 10^{-5}$ mole/kg-emulsion) | | | Relative Sensitivity | Fog |
|---|---|---|---|---|---|---|
| (Comparison) | 31 | I-1 10 | | | 100* | 0.03 |
| (Comparison) | 32 | I-1 20 | | | 151 | 0.03 |
| (Comparison) | 33 | I-1 40 | | | 151 | 0.03 |
| (Comparison) | 34 | I-2 10 | | | 100 | 0.03 |
| (Comparison) | 35 | I-2 20 | | | 141 | 0.03 |
| (Comparison) | 36 | I-2 40 | | | 141 | 0.03 |
| (Comparison) | 37 | I-3 10 | | | 112 | 0.03 |
| (Comparison) | 38 | I-3 20 | | | 166 | 0.03 |
| (Comparison) | 39 | I-3 40 | | | 165 | 0.03 |
| (Comparison) | 40 | B 10 | | | 110 | 0.06 |
| (Comparison) | 41 | B 20 | | | 151 | 0.07 |
| (Comparison) | 42 | B 40 | | | 151 | 0.07 |
| (Comparison) | 43 | | II-1 10 | | 166 | 0.03 |
| (Comparison) | 44 | | II-1 20 | | 234 | 0.03 |
| (Comparison) | 45 | | II-1 40 | | 234 | 0.03 |
| (Comparison) | 46 | | II-2 10 | | 182 | 0.03 |
| (Comparison) | 47 | | II-2 20 | | 209 | 0.03 |
| (Comparison) | 48 | | II-2 40 | | 210 | 0.03 |
| (Comparison) | 49 | | II-4 10 | | 191 | 0.03 |
| (Comparison) | 50 | | II-4 20 | | 245 | 0.03 |
| (Comparison) | 51 | | II-4 40 | | 245 | 0.03 |
| (Comparison) | 52 | | C 10 | | 126 | 0.05 |
| (Comparison) | 53 | | C 20 | | 175 | 0.06 |
| (Comparison) | 54 | | C 40 | | 176 | 0.06 |
| (Comparison) | 55 | | | III-3 10 | 130 | 0.03 |
| (Comparison) | 56 | | | III-3 20 | 193 | 0.03 |
| (Comparison) | 57 | | | III-3 40 | 192 | 0.03 |
| (Comparison) | 58 | | | III-7 10 | 124 | 0.03 |
| (Comparison) | 59 | | | III-7 20 | 175 | 0.03 |
| (Comparison) | 60 | | | III-7 40 | 175 | 0.03 |

TABLE 2-continued

| Test No. | | Sensitizing Dye and Amount ($\times 10^{-5}$ mole/kg-emulsion) | | | Relative Sensitivity | Fog |
|---|---|---|---|---|---|---|
| (Comparison) | 61 | | | III-16 10 | 135 | 0.03 |
| (Comparison) | 62 | | | III-16 20 | 202 | 0.03 |
| (Comparison) | 63 | | | III-16 40 | 202 | 0.03 |
| (Comparison) | 64 | | | A 10 | 131 | 0.05 |
| (Comparison) | 65 | | | A 20 | 186 | 0.06 |
| (Comparison) | 66 | | | A 40 | 186 | 0.06 |
| (Comparison) | 67 | I-1 20 | II-1 10 | | 288 | 0.03 |
| (Comparison) | 68 | I-1 20 | II-1 20 | | 331 | 0.03 |
| (Comparison) | 69 | I-1 20 | II-4 10 | | 316 | 0.03 |
| (Comparison) | 70 | I-1 20 | II-4 20 | | 347 | 0.03 |
| (Comparison) | 71 | I-1 20 | C 10 | | 130 | 0.05 |
| (Comparison) | 72 | I-1 20 | C 20 | | 181 | 0.06 |
| (Comparison) | 73 | I-2 10 | II-2 20 | | 331 | 0.03 |
| (Comparison) | 74 | I-2 20 | II-2 20 | | 355 | 0.03 |
| (Comparison) | 75 | I-3 10 | II-2 20 | | 339 | 0.03 |
| (Comparison) | 76 | I-3 20 | II-2 20 | | 363 | 0.03 |
| (Comparison) | 77 | B 10 | II-2 20 | | 224 | 0.06 |
| (Comparison) | 78 | B 20 | II-2 20 | | 248 | 0.07 |
| (Comparison) | 79 | B 10 | C 20 | | 131 | 0.07 |
| (Comparison) | 80 | B 20 | C 20 | | 182 | 0.07 |
| (This Invention) | 81 | I-1 20 | II-1 20 | III-3 10 | 377 | 0.03 |
| (This Invention) | 82 | I-1 20 | II-1 20 | III-3 20 | 409 | 0.03 |
| (This Invention) | 83 | I-1 20 | II-1 20 | III-7 10 | 350 | 0.03 |
| (This Invention) | 84 | I-1 20 | II-1 20 | III-7 20 | 378 | 0.03 |
| (This Invention | 85 | I-1 20 | II-1 20 | III-16 10 | 380 | 0.03 |
| (This Invention) | 86 | I-1 20 | II-1 20 | III-16 20 | 415 | 0.03 |
| (Comparison) | 87 | I-1 20 | II-1 20 | A 10 | 342 | 0.06 |
| (Comparison) | 88 | I-1 20 | II-1 20 | A 20 | 360 | 0.07 |
| (This Invention) | 89 | I-1 20 | II-4 20 | III-3 10 | 392 | 0.03 |
| (This Invention) | 90 | I-1 20 | II-4 20 | III-3 20 | 420 | 0.03 |
| (This Invention) | 91 | I-1 20 | II-4 20 | III-7 10 | 368 | 0.03 |
| (This Invention) | 92 | I-1 20 | II-4 20 | III-7 20 | 391 | 0.03 |
| (This Invention) | 93 | I-1 20 | II-4 20 | III-16 10 | 410 | 0.03 |
| (This Invention) | 94 | I-1 20 | II-4 20 | III-16 20 | 430 | 0.03 |
| (Comparison) | 95 | I-1 20 | II-4 20 | A 10 | 351 | 0.06 |
| (Comparison) | 96 | I-1 20 | II-4 20 | A 20 | 370 | 0.07 |
| (Comparison) | 97 | I-1 20 | C 20 | III-3 10 | 202 | 0.06 |
| (Comparison) | 98 | I-1 20 | C 20 | III-3 20 | 255 | 0.06 |
| (Comparison) | 99 | I-1 20 | C 20 | III-7 10 | 190 | 0.06 |
| (Comparison) | 100 | I-1 20 | C 20 | III-7 20 | 220 | 0.06 |
| (Comparison) | 101 | I-1 20 | C 20 | III-16 10 | 214 | 0.06 |
| (Comparison) | 102 | I-1 20 | C 20 | III-16 20 | 261 | 0.06 |
| (Comparison) | 103 | I-1 20 | C 20 | A 10 | 187 | 0.07 |
| (Comparison) | 104 | I-1 20 | C 20 | A 20 | 205 | 0.08 |
| (This Invention) | 105 | I-2 20 | II-2 20 | III-3 10 | 380 | 0.03 |
| (This Invention) | 106 | I-2 20 | II-2 20 | III-3 20 | 428 | 0.03 |
| (This Invention) | 107 | I-2 20 | II-2 20 | III-7 10 | 369 | 0.03 |
| (This Invention) | 108 | I-2 20 | II-2 20 | III-7 20 | 398 | 0.03 |
| (This Invention) | 109 | I-2 20 | II-2 20 | III-16 10 | 388 | 0.03 |
| (This Invention) | 110 | I-2 20 | II-2 20 | III-16 20 | 434 | 0.03 |
| (Comparison) | 111 | I-2 20 | II-2 20 | A 10 | 360 | 0.07 |
| (Comparison) | 112 | I-2 20 | II-2 20 | A 20 | 380 | 0.07 |
| (This Invention) | 113 | I-3 20 | II-2 20 | III-3 10 | 385 | 0.03 |
| (This Invention) | 114 | I-3 20 | II-2 20 | III-3 20 | 436 | 0.03 |
| (This Invention) | 115 | I-3 20 | II-2 20 | III-7 10 | 375 | 0.03 |
| (This Invention) | 116 | I-3 20 | II-2 20 | III-7 20 | 405 | 0.03 |
| (This | 117 | I-3 20 | II-2 20 | III-16 10 | 396 | 0.03 |

TABLE 2-continued

| Test No. | | Sensitizing Dye and Amount ($\times 10^{-5}$ mole/kg-emulsion) | | | Relative Sensitivity | Fog |
|---|---|---|---|---|---|---|
| Invention) | | | | | | |
| (This Invention) | 118 | I-3 20 | II-2 20 | III-16 20 | 443 | 0.03 |
| (Comparison) | 119 | I-3 20 | II-2 20 | A 10 | 367 | 0.06 |
| (Comparison) | 120 | I-3 20 | II-2 20 | A 20 | 388 | 0.07 |
| (Comparison) | 121 | B 20 | II-2 20 | III-3 10 | 264 | 0.07 |
| (Comparison) | 122 | B 20 | II-2 20 | III-3 20 | 315 | 0.07 |
| (Comparison) | 123 | B 20 | II-2 20 | III-7 10 | 252 | 0.07 |
| (Comparison) | 124 | B 20 | II-2 20 | III-7 20 | 285 | 0.07 |
| (Comparison) | 125 | B 20 | II-2 20 | III-16 10 | 278 | 0.07 |
| (Comparison) | 126 | B 20 | II-2 20 | III-16 20 | 320 | 0.07 |
| (Comparison) | 127 | B 20 | II-2 20 | A 10 | 238 | 0.08 |
| (Comparison) | 128 | B 20 | II-2 20 | A 20 | 251 | 0.08 |
| (Comparison) | 129 | B 20 | C 20 | III-3 10 | 202 | 0.07 |
| (Comparison) | 130 | B 20 | C 20 | III-3 20 | 254 | 0.07 |
| (Comparison) | 131 | B 20 | C 20 | III-7 10 | 192 | 0.07 |
| (Comparison) | 132 | B 20 | C 20 | III-7 20 | 224 | 0.07 |
| (Comparison) | 133 | B 20 | C 20 | III-16 10 | 213 | 0.07 |
| (Comparison) | 134 | B 20 | C 20 | III-16 20 | 261 | 0.07 |
| (Comparison) | 135 | B 20 | C 20 | A 10 | 162 | 0.08 |
| (Comparison) | 136 | B 20 | C 20 | A 20 | 196 | 0.08 |

*Standard

Dye B
(Same dye as described in U.S. Pat. No. 3,580,724)

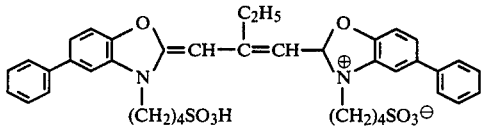

Dye C
(Same dye as described in U.S. Pat. No. 3,580,724)

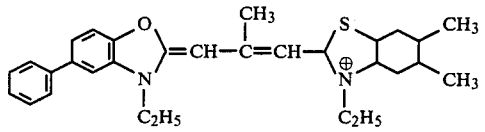

EXAMPLE 2

A chemically sensitized silver iodobromide emulsion (mean grain size of 1.1 microns, gelatin content of 70 g/kg of the emulsion, and silver content of 0.7 mole/kg of the emulsion) containing 8 mole% silver iodide was prepared. To 1 kg of the emulsion was added 500 g of an emulsion of color coupler D shown below at 40° C. The emulsion of color coupler D was prepared by adding 400 ml of tricresyl phosphate to 200 ml of ethyl acetate, dissolving 100 g of color coupler D in the mixture, adding thereto 10 g of sodium dodecylbenzenesulfonate, and then dispersing the mixture in 1,000 g of an aqueous 10% gelatin solution by means of a homoblender.

A definite amount of a 0.2% methanol solution of the sensitizing dye or dyes as shown in Table 3 was added to the emulsion and the mixture was stirred. Furthermore, 20 ml of an aqueous solution of 1.0% by weight 4-hydroxy-6-methyl-1,3,3a,7-tetraazaindene, 50 ml of an aqueous solution of 2.0% by weight 1-hydroxy-3,5-dichlorotriazine sodium salt, and 10 ml of an aqueous solution of 2.0% by weight sodium dodecylbenzenesulfonate were added to the emulsion followed by stirring, to produce a color negative silver halide emulsion.

The finished emulsion thus obtained was coated on a cellulose triacetate film base at a silver coverage of 5 g/m$^2$ and dried to provide each film sample.

Each film sample thus obtained was exposed through an optical wedge with a green filter (BPB-53) made by Fuji Photo Film Co., Ltd., using an actinometer having a light of color temperature of 5400° K.

After exposure, each sample was subjected to the photographic processing as shown below, dried, and the density of the magenta dye images thus formed was measured. The standard point of the optical density for determining the sensitivity was fog+0.20 and the relative sensitivity was determined by the results obtained are shown in Table 3 below.

The photographic processing process used above was as follows:

| Photographic Processing (38° C.) | |
|---|---|
| 1. Color Development | 3 min. 15 sec. |
| 2. Bleach | 6 min. 30 sec. |
| 3. Wash | 3 min. 15 sec. |
| 4. Fix | 6 min. 30 sec. |
| 5. Wash | 3 min. 15 sec. |
| 6. Stabilization | 3 min. 15 sec. |

The compositions of the processing solutions used in the above processing were as follows.

| | |
|---|---|
| **Color Developer** | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methyl-aniline Sulfate | 4.5 g |
| Water to make | 1 liter |
| **Bleach Solution** | |
| Ammonium Bromide | 160.0 g |
| Aqueous Ammonia (28%) | 25.0 ml |
| Ethylenediametetraacetic Acid Sodium Iron Salt | 130.0 g |
| Glacial Acetic Acid | 14.0 ml |
| Water to make | 1 liter |
| **Fix Solution** | |
| Sodium Tetrapolyphosphate | 2.0 g |
| Sodium Sulfite | 4.0 g |
| Ammonium thiosulfate (70%) | 175.0 ml |
| Sodium Hydrogensulfite | 4.6 g |
| Water to make | 1 liter |
| **Stabilizing Solution** | |
| Formalin | 8 ml |
| Water to make | 1 liter |

Coupler D

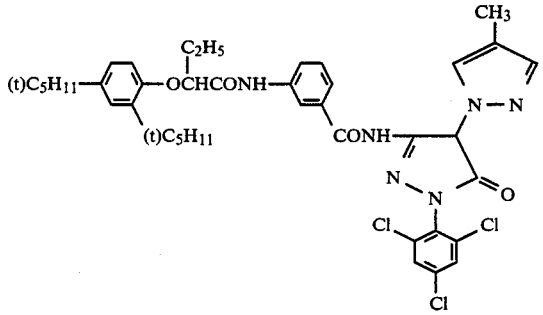

TABLE 3

| Test No. | | Sensitizing Dye and Amount ($\times 10^{-5}$ mole/kg-emulsion) | | | Relative Sensitivity | Fog |
|---|---|---|---|---|---|---|
| (Comparison) | 201 | I-3 10 | | | 100* | 0.05 |
| (Comparison) | 202 | I-3 20 | | | 149 | 0.05 |
| (Comparison) | 203 | I-3 40 | | | 149 | 0.05 |
| (Comparison) | 204 | | II-2 10 | | 160 | 0.05 |
| (Comparison) | 205 | | II-2 20 | | 190 | 0.05 |
| (Comparison) | 206 | | II-2 40 | | 189 | 0.05 |
| (Comparison) | 207 | | | III-16 10 | 121 | 0.05 |
| (Comparison) | 208 | | | III-16 20 | 179 | 0.05 |
| (Comparison) | 209 | | | III-16 40 | 179 | 0.05 |
| (Comparison) | 210 | I-3 10 | II-2 20 | | 298 | 0.05 |
| (Comparison) | 211 | I-3 20 | II-2 20 | | 321 | 0.05 |
| (Comparison) | 212 | | II-2 20 | III-16 10 | 310 | 0.05 |
| (Comparison) | 213 | | II-2 20 | III-16 20 | 335 | 0.05 |
| (Comparison) | 214 | | II-2 20 | III-16 40 | 336 | 0.05 |
| (Comparison) | 215 | I-3 10 | | III-16 20 | 290 | 0.05 |
| (Comparison) | 216 | I-3 20 | | III-16 20 | 316 | 0.05 |
| (This Invention) | 217 | I-3 20 | II-2 20 | III-16 10 | 356 | 0.05 |
| (This Invention) | 218 | I-3 20 | II-2 20 | III-16 20 | 398 | 0.05 |
| (This Invention) | 219 | I-3 20 | II-2 20 | III-16 40 | 398 | 0.05 |
| (Comparison) | 220 | | | A 10 | 115 | 0.07 |
| (Comparison) | 221 | | | A 20 | 171 | 0.08 |
| (Comparison) | 222 | | | A 40 | 170 | 0.08 |
| (Comparison) | 223 | I-3 20 | II-2 20 | A 10 | 329 | 0.11 |
| (Comparison) | 224 | I-3 20 | II-2 20 | A 20 | 349 | 0.12 |
| (Comparison) | 225 | I-3 20 | II-2 20 | A 40 | 350 | 0.12 |

*Standard

As is clear from the results shown in Table 3, by using the combination of three kinds of sensitizing dyes according to this invention, the relative sensitivity of a silver halide color photographic material can be greatly increased without increasing fog (Test Nos. 217 to 219).

EXAMPLE 3

Samples of multilayer color photographic material were prepared by coating the following layers on a cellulose triacetate film support.

The 1st layer: Antihalation layer:

A gelatin layer containing 0.10 g/m$^2$ of black colloidal silver, 0.10 g/m$^2$ of Ultraviolet Absorbent C-1, and 0.70 g/m$^2$ of Ultraviolet Absorbent C-2.

The 2nd Layer: Interlayer:

A gelatin layer containing 0.10 g/m$^2$ of Compound H-1 and 0.15 g/m$^2$ of a silver iodobromide emulsion (1 mole% silver iodide, mean grain size of 0.07$\mu$).

The 3rd Layer: A 1st red-sensitive emulsion layer:

A gelatin layer containing 0.60 g/m$^2$ of a silver iodobromide emulsion (6 mole% silver iodide, mean grain size 0.5$\mu$), $7.0\times10^{-5}$ mole (per mole of silver) of Sensitizing Dye I, $2.0\times10^{-5}$ mole (per mole of silver) of Sensitizing Dye II, $2.8\times10^{-4}$ mole (per mole of silver) of Sensitizing Dye III, $2.0\times10^{-5}$ (per mole of silver) of Sensitizing Dye IV, 0.20 g/m$^2$ of Coupler C-3, 0.01 g/m$^2$ of Coupler C-4, and 0.01 g/m$^2$ of Coupler C-5.

The 4th Layer: A 2nd red-sensitive emulsion layer:

A gelatin layer containing 0.5 g/m$^2$ of a silver iodobromide emulsion (6 mole% silver iodide, mean grain size of 0.8$\mu$), $5.2\times10^{-5}$ mole (per mole of silver) of Sensitizing Dye I, $1.5\times10^{-5}$ mole (per mole of silver) of Sensitizing Dye II, $2.1\times10^{-4}$ mole (per mole of silver) of Sensitizing Dye III, $1.5\times10^{-5}$ mole (per mole of silver) of Sensitizing Dye IV, 0.20 g/m$^2$ of Coupler C-3, 0.01 g/m$^2$ of Coupler C-4, and 0.01 g/m$^2$ of Coupler C-5.

The 5th Layer: A 3rd red-sensitive emulsion layer:

A gelatin layer containing 1.0 g/m$^2$ of a silver iodobromide emulsion (6 mole% silver iodide, mean grain size of 1.3$\mu$), $5.5\times10^{-5}$ mole (per mole of silver) of Sensitizing Dye I, $1.6\times10^{-5}$ mole (per mole of silver) of Sensitizing Dye II, $2.2\times10^{-5}$ mole (per mole of silver) of Sensitizing Dye III, $1.6\times10^{-5}$ mole (per mole of silver) of Sensitizing Dye IV, and 0.10 g/m$^2$ of Coupler C-3.

The 6th Layer: Interlayer:

A gelatin layer containing 0.02 g/m$^2$ of Compound H-1.

The 7th Layer: A 1st green-sensitive emulsion layer:

A gelatin layer containing 0.30 g/m$^2$ of a silver iodobromide emulsion (5 mole% silver iodide, mean grain size of 0.4$\mu$), the sensitizing dye or dyes shown in Table 4, 0.20 g/m$^2$ of Coupler C-6, 0.04 g/m$^2$ of Coupler C-7, 0.04 g/m$^2$ of Coupler C-8, and 0.01 g/m$^2$ of Coupler C-4.

The 8th Layer: A 2nd green-sensitive emulsion layer:

A gelatin layer containing 0.3 g/m$^2$ of a silver iodobromide emulsion (6 mole% silver iodide, mean grain size of 0.8$\mu$), the sensitizing dye or dyes shown in Table 4, 0.04 g/m$^2$ of Coupler C-9, 0.001 g/m$^2$ of Coupler C-7, and 0.001 g/m$^2$ of Coupler C-8.

The 9th Layer: A 3rd green-sensitive emulsion layer:

A gelatin layer containing 0.8 g/m$^2$ of a silver iodobromide emulsion (6 mole% silver iodide, mean grain size of 1.3$\mu$), the sensitizing dye or dyes shown in Table 4, 0.03 g/m$^2$ of Coupler C-9, and 0.001 g/m$^2$ of Coupler C-8.

The 10th Layer: A yellow filter layer:

A gelatin layer containing 0.050 g/m$^2$ of yellow colloidal silver and 0.20 g/m$^2$ of Compound H-1.

The 11th Layer: A 1st blue-sensitive emulsion layer:

A gelatin layer containing 0.30 g/m$^2$ of silver iodobromide emulsion (5 mole% silver iodide, mean grain size of 0.3$\mu$), 0.68 g/m$^2$ of Coupler C-10, and 0.03 g/m$^2$ of Coupler C-4.

The 12th Layer: A 2nd blue-sensitive emulsion layer:

A gelatin layer containing 0.30 g/m$^2$ of a silver iodobromide emulsion (6 mole% silver iodide, mean grain size of 0.8$\mu$) and 0.22 g/m$^2$ of Coupler C-10.

The 13th Layer: A 3rd blue-sensitive emulsion layer:

A gelatin layer containing 0.80 g/m$^2$ of a silver iodobromide emulsion (7 mole% silver iodide, mean grain size of 1.3$\mu$), $2.3\times10^{-4}$ mole (per mole of silver) of Sensitizing Dye V, and 0.19 g/m$^2$ of Coupler C-10.

The 14th Layer: A 1st protective layer:

A gelatin layer containing 0.20 g/m$^2$ of Ultraviolet Absorbent C-1 and 0.90 g/m$^2$ of Ultraviolet absorbent C-2.

The 15th Layer: A 2nd protective layer:

A gelatin layer containing 0.05 g/m$^2$ of polymethyl methacrylate particles (diameter of about 1.5$\mu$).

Each of the above-described layers also contained gelatin hardening agent C-11 and a surface active agent. Thus, samples 301 to 317 were prepared.

The compounds used for preparing the above samples were as follows.

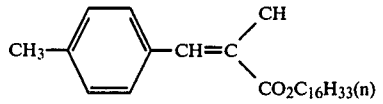
C-1
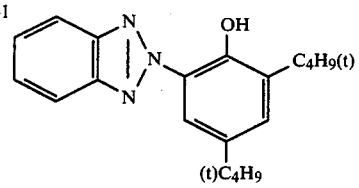
C-2
C-3
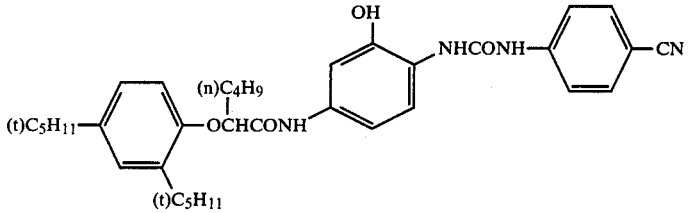
C-4
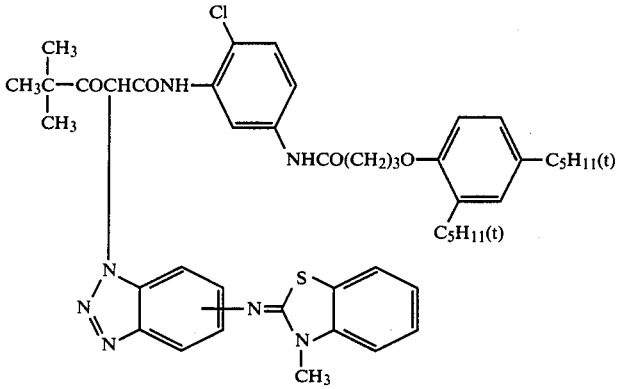
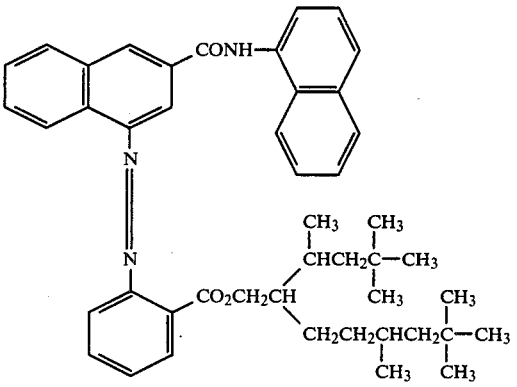
C-5
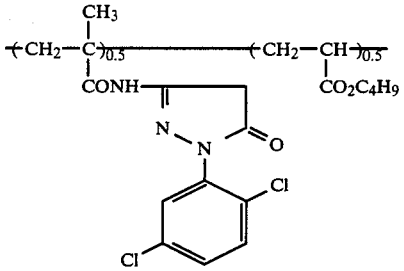
C-6
C-7
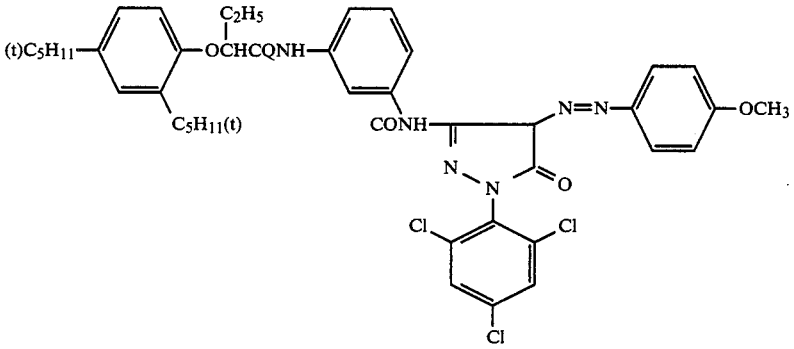

-continued
C-8
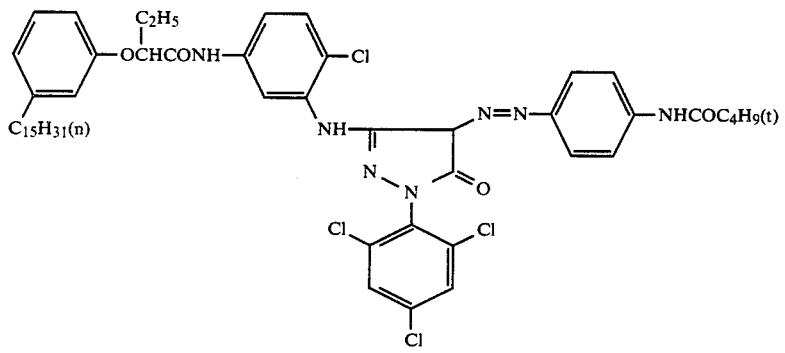
C-9
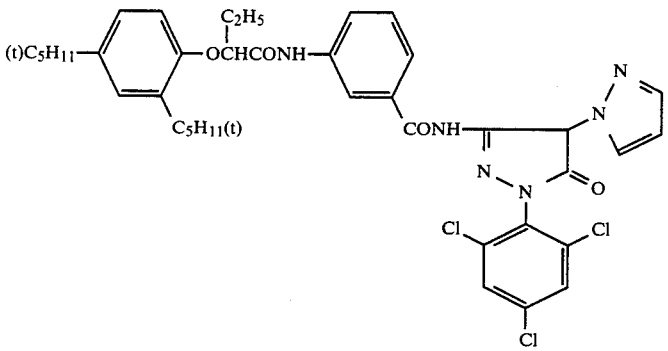
C-10 $(CH_2{=}CHSO_2CH_2CONHCH_2)_2$
C-11
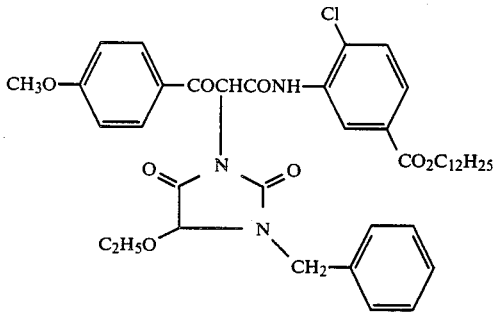
H-1
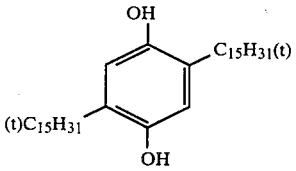
Sensitizing Dye I
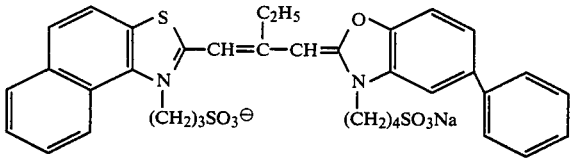
Sensitizing Dye II
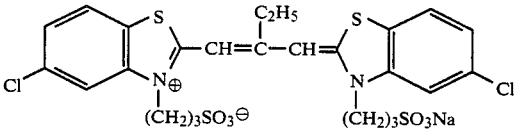
Sensitizing Dye III
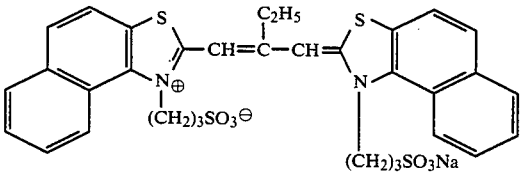

-continued

Sensitizing Dye IV

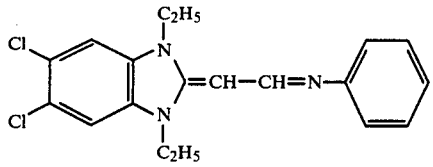

Sensitizing Dye V

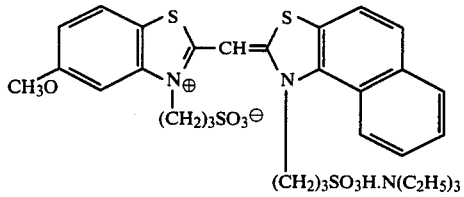

Each sample was wedge exposed to white light and processed by the following process at a processing temperature of 38° C.

| Photographic Processing | |
|---|---|
| 1. Color Development | 3 min. 15 sec. |
| 2. Bleach | 6 min. 30 sec. |
| 3. Wash | 3 min. 15 sec. |
| 4. Fix | 6 min. 30 sec. |
| 5. Wash | 3 min. 15 sec. |
| 6. Stabilization | 3 min. 15 sec. |

The compositions of the processing solutions used in the above process were as follows.

| Color Developer | |
|---|---|
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methylaniline Sulfate | 4.5 g |
| Water to make | 1 liter. |
| **Bleach Solution** | |
| Ammonium Bromide | 160.0 g |
| Aqueous Ammonia (28%) | 25.0 ml |
| Ethylenediaminetetraacetic Acid Sodium Iron Salt | 130.0 g |
| Glacial Acetic Acid | 14.0 ml |
| Water to make | 1 liter. |
| **Fix Solution** | |
| Sodium Tetrapolyphosphate | 2.0 g |
| Sodium Sulfite | 4.0 g |
| Ammonium Thiosulfate (70%) | 175.0 ml |
| Sodium Hydrogenphosphite | 4.6 g |
| Water to make | 1 liter |

-continued

| Stabilizing Solution | |
|---|---|
| Formalin | 8.0 ml |
| Water to make | 1 liter. |

The photographic properties of the green-sensitive emulsion layers are shown in Table 4 below. In the Table, $S_{0.2}$ indicates the relative values (defining that of Sample 301 as 100) of the exposure amount (log E) for giving the minimum image density+0.2. Also, $G_{1.5}$ indicates the difference between the image density of $S_{0.2}$ and the image density of the exposure amount of the exposure amount (log E) at $S_{0.2}+1.5$.

In the example, Comparison sensitizing dye A was the same as that used in Example 1.

TABLE 4

| Test No. | Sensitizing dye in the 7th layer and the amount | | | Sensitizing dye in the 8th layer and the amount | | | Sensitizing dye in the 9th layer and the amount | | | Fog | Relative Density S 0.2 | $\bar{G}$ 1.5 |
|---|---|---|---|---|---|---|---|---|---|---|---|---|
| 301 | I-3 20 | | | I-3 13 | | | I-3 15 | | | 0.06 | 100* | 0.80 |
| 302 | I-3 40 | | | I-3 25 | | | I-3 30 | | | 0.06 | 142 | 0.81 |
| 303 | I-3 80 | | | I-3 50 | | | I-3 60 | | | 0.06 | 142 | 0.81 |
| 304 | | II-2 2 | | | II-2 2 | | | II-2 2 | | 0.06 | 42 | 0.75 |
| 305 | | II-2 4 | | | II-2 4 | | | II-2 4 | | 0.06 | 76 | 0.77 |
| 306 | | II-2 8 | | | II-2 8 | | | II-2 8 | | 0.06 | 93 | 0.79 |
| 307 | | | III-16 8 | | | III-16 5 | | | III-16 6 | 0.06 | 111 | 0.80 |
| 308 | | | III-16 15 | | | III-16 10 | | | III-16 12 | 0.06 | 168 | 0.81 |
| 309 | | | III-16 30 | | | III-16 20 | | | III-16 24 | 0.06 | 169 | 0.81 |
| 310 | I-3 40 | II-2 4 | | I-3 25 | II-2 4 | | I-3 30 | II-2 4 | | 0.06 | 220 | 0.83 |
| 311 | | II-2 4 | III-16 15 | | II-2 4 | III-16 10 | | II-2 4 | III-16 12 | 0.06 | 205 | 0.83 |
| 312 | I-3 40 | | III-16 15 | I-3 25 | | III-16 10 | I-3 30 | | III-16 12 | 0.06 | 238 | 0.84 |
| 313 | I-3 40 | II-2 4 | III-16 15 | I-3 40 | II-2 4 | III-16 10 | I-3 30 | II-2 4 | III-16 12 | 0.06 | 293 | 0.88 |
| 314 | | | A 8 | | | A 5 | | | A 6 | 0.09 | 98 | 0.78 |
| 315 | | | A 15 | | | A 10 | | | A 12 | 0.10 | 147 | 0.79 |
| 316 | | | A 30 | | | A 20 | | | A 24 | 0.10 | 148 | 0.80 |
| 317 | I-3 40 | II-2 4 | A 15 | I-3 40 | II-2 4 | A 10 | I-3 30 | II-2 4 | A 12 | 0.13 | 268 | 0.85 |

(The amount of dye: $\times 10^{-5}$ mole/mole of Ag)
Test Nos. 301 to 312 and 314 to 317: Comparison Samples
Test No. 313: Sample of this invention
*Standard As is clear from the results shown in Table 4, by using the combination of the three sensitizing dyes according to this invention (Test No. 313), a high contrast and greatly high relative sensitivity can be obtained without increasing the formation of fog.

While the invention has been described in detail and with reference to specific embodiments thereof, it will be apparent to one skilled in the art that various changes and modifications can be made therein without departing from the spirit and scope thereof.

What is claimed is:

1. A light-sensitive silver halide photographic emulsion comprising light-sensitive silver halide, a binder, and at least one sensitizing dye represented by following general formula (I), at least one sensitizing dye represented by following general formula (II), and at least one sensitizing dye represented by following general formula (III):

General formula (I)

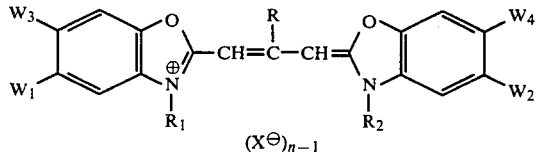

wherein $R_1$ and $R_2$ each represents a substituted or unsubstituted alkyl group, at least one of $R_1$ and $R_2$ being a sulfoalkyl group or a carboxyalkyl group; R represents an alkyl group or an aralkyl group; $W_1$, $W_2$, $W_3$, and $W_4$, which may be the same or different, each represents a hydrogen atom, a halogen atom, an aryl group, an alkyl group, a substituted alkyl group, an alkoxy group, an alkoxycarbonyl group, a carboxy group, or a hydroxy group, provided that $W_1$ and $W_2$ are not both a phenyl group; $X^{\ominus}$ represents an acid anion; n represents 1 or 2, n being 1 when the dye forms an intramolecular salt;

General formula (II)

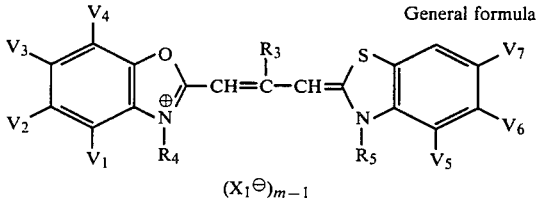

wherein $R_4$ and $R_5$ each represents a substituted or unsubstituted alkyl group; at least one of $R_4$ and $R_5$ being a sulfoalkyl group or a carboxyalkyl group; $R_3$ represents an ethyl group, a propyl group, or an aralkyl group; $V_1$, $V_2$, $V_3$, $V_4$, $V_5$, $V_6$, and $V_7$, which may be the same or different, each represents a hydrogen atom, a halogen atom, an aryl group, an alkyl group, a substituted alkyl group, an alkoxy group, an alkoxycarbonyl group, a carboxy group, or a hydroxy group; provided that any of $V_1$ and $V_2$, $V_2$ and $V_3$, $V_3$ and $V_4$, $V_5$ and $V_6$, or $V_6$ and $V_7$ may combine to form a benzene ring; $X_1^{\ominus}$ represents an acid anion; m represents 1 or 2, m being 1 when the dye forms an intramolecular salt;

General formula (III)

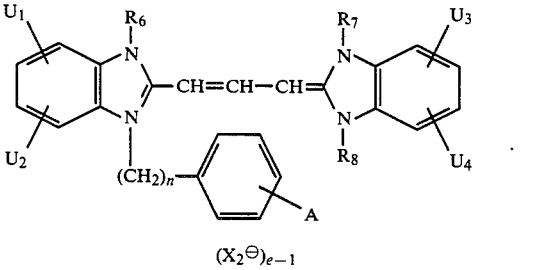

wherein $R_6$, $R_7$, and $R_8$, which may be the same or different, each represents an aliphatic group; $U_1$, $U_2$, $U_3$, and $U_4$, which may be the same or different, each represents a hydrogen atom, a halogen atom, an aliphatic hydrocarbon group, an acyl group, an acyloxy group, an alkoxycarbonyl group, a carbamoyl group, sulfamoyl group, a cyano group, a trifluoromethyl group or a hydroxy group; A represents a sulfo group or a carboxy group; $X_2^{\ominus}$ represents an acid anion; h represents an integer of 1 to 6; and e represents 1 or 2.

2. The light-sensitive silver halide photographic emulsion as claimed in claim 1, wherein said silver halide photographic emulsion is a silver iodobromide emulsion.

3. The light-sensitive silver halide photographic emulsion as claimed in claim 1, wherein said silver halide photographic emulsion contains a color coupler.

4. The light-sensitive silver halide photographic emulsion as claimed in claim 3, wherein said color coupler is a magenta coupler.

5. The light-sensitive silver halide photographic emulsion as claimed in claim 4, wherein said magenta coupler is a two-equivalent magenta coupler.

6. The light-sensitive silver halide photographic emulsion as claimed in claim 1, wherein $R_3$ represents an ethyl group, a propyl group, a benzyl group or a phenethyl group; h represents an integer of 1 to 4; $W_1$ and $W_2$ each represents a chlorine atom, a phenyl group, a methyl group, a methoxy group, or a trifluoromethyl group; $W_3$ and $W_4$ are each a hydrogen atom; and $R_6$, $R_7$ and $R_8$ each represents a lower aliphatic group having 6 or fewer carbon atoms.

7. The light-sensitive silver halide photographic emulsion as claimed in claim 2, wherein said silver iodobromide emulsion contains silver iodobromide grains having a mean grain size of less than about $4\mu$.

8. The light-sensitive silver halide photographic emulsion as claimed in claim 1, wherein each of said sensitizing dyes represented by general formulae (I), (II) and (III) is present in said silver halide emulsion in an amount of from about $1\times10^{-6}$ mol to $8\times10^{-3}$ mol per mol of silver halide.

9. The light-sensitive silver halide photographic emulsion as claimed in claim 8, wherein each of said sensitizing dyes represented by general formulae (I), (II) and (III) is present in said silver halide emulsion in an amount of from about $3\times10^{-6}$ mol to $2.5\times10^{-3}$ mol per mol of silver halide.

10. The light-sensitive silver halide photographic emulsion as claimed in claim 9, wherein each of said sensitizing dyes represented by general formulae (I), (II) and (III) is present in said silver halide emulsion in an amount of about $1\times10^{-3}$ mol per mol of silver halide.

11. The light-sensitive silver halide photographic emulsion as claimed in claim 1, wherein the molar ratio of said dye represented by general formula (II) to said dye represented by general formula (I) is from about 1:30 to 10:1, and the molar ratio of said dye represented by general formula (III) to said dye represented by general formula (I) is from about 1:10 to 10:1.

12. The light-sensitive silver halide photographic emulsion as claimed in claim 11, wherein the molar ratio of said dye represented by general formula (II) to said dye represented by general formula (I) is from about 1:20 to 2:1, and the molar ratio of said dye represented by general formula (III) to said dye represented by general formula (I) is from about 1:5 to 5:1.

13. The light-sensitive silver halide photographic emulsion as claimed in claim 1, wherein the general formula (I), R represents an ethyl group, a phenethyl group or a benzyl group; $R_1$ and $R_2$ each represents a substituted or unsubstituted lower alkyl group having 6 or fewer cabon atoms; $W_1$ and $W_2$ each represents a chlorine atom, a phenyl group, a methyl group, a methoxy group, or a trifluoromethyl group; and $W_3$ and $W_4$ each represents a hydrogen atom.

14. The light-sensitive silver halide photographic emulsion as claimed in claim 1, wherein in general formula (II), $R_3$ represents a lower alkyl group; $R_4$ and $R_5$ each represents a substituted or unsubstituted lower alkyl group having 6 or fewer carbon atoms; and $V_1$, $V_2$, $V_3$, $V_4$, $V_5$, $V_6$ and $V_7$ each represents a hydrogen atom, a phenyl group, or a lower alkoxy group having 6 or fewer carbon atoms.

15. The light-sensitive silver halide photographic emulsion as claimed in claim 1, wherein general formula (III), $R_6$ represents a lower alkyl group having 6 or fewer carbon atoms; $R_7$ and $R_8$ each represents a substituted or unsubstituted lower alkyl group having 6 or fewer carbon atoms; A represents a sulfo group; and $U_1$, $U_2$, $U_3$ and $U_4$ each represents a fluorinated lower alkyl group having 6 or fewer carbon atoms, a halogen atom, or a cyano group.

* * * * *